US005168280A

United States Patent [19]

Blaese

[11] Patent Number: 5,168,280

[45] Date of Patent: Dec. 1, 1992

[54] ANTENNA WITH PUSH-IN CABLE CONNECTOR

[76] Inventor: Herbert R. Blaese, 3314 Olcott Ave., Chicago, Ill. 60634

[21] Appl. No.: 746,782

[22] Filed: Aug. 16, 1991

[51] Int. Cl.[5] ..... H01Q 1/32

[52] U.S. Cl. ..... 343/715; 343/906

[58] Field of Search ..... 343/715, 906, 900, 713, 343/711, 830; 439/916

[56] References Cited

U.S. PATENT DOCUMENTS

| | | | |
|---|---|---|---|
| 2,468,391 | 4/1949 | Cejka | 343/906 |
| 2,481,823 | 9/1949 | Cejka | 343/901 |
| 2,755,330 | 7/1956 | Ludwig et al. | 439/916 |
| 2,850,305 | 9/1958 | Chadowski et al. | 343/715 |
| 4,804,969 | 2/1989 | Blaese | 343/715 |
| 4,825,217 | 4/1989 | Choi | 343/715 |
| 4,862,183 | 8/1989 | Blaese | 343/715 |
| 4,873,532 | 10/1989 | Sakurai et al. | 343/713 |

*Primary Examiner*—Rolf Hille
*Assistant Examiner*—Hoanganh Le
*Attorney, Agent, or Firm*—Gerstman & Ellis, Ltd.

[57] ABSTRACT

An antenna cable connector system is provided comprising a coaxial cable having a main central conductor, a coaxial dielectric, a coaxial braid conductor, and an outer insulative jacket. A connector having a conductive tube at its distal end receives the main central conductor. A main body portion is provided for receiving the coaxial dielectric. A sleeve is located proximal to the main body portion for surrounding the outer insulative jacket. An antenna box is provided having means for receiving the connector with a push-in fit. The receiving means includes a conductive member having an opening for receiving the conductive tube. A set screw carried within a lateral passage defined by the antenna box locks the connector to the antenna box.

10 Claims, 1 Drawing Sheet

Fig. 1
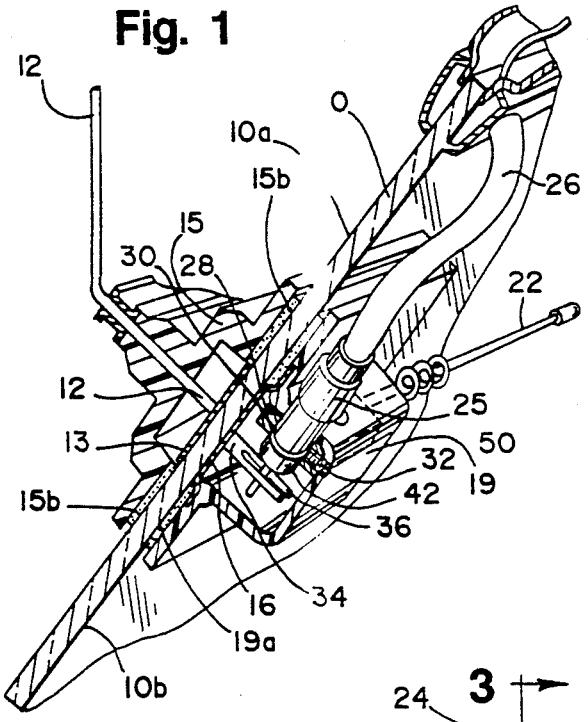
Fig. 8
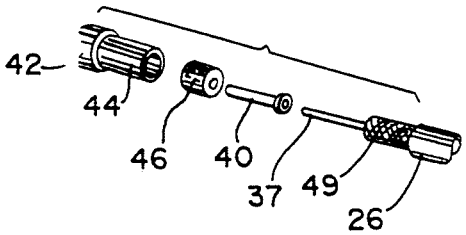
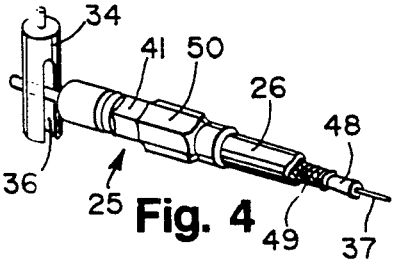
Fig. 4
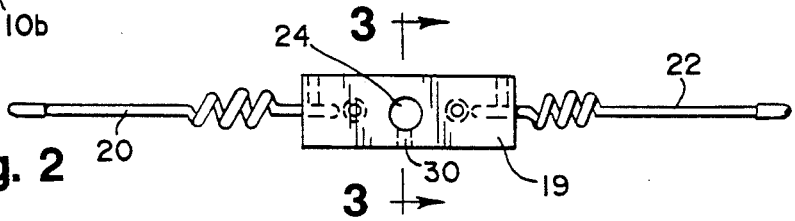
Fig. 2
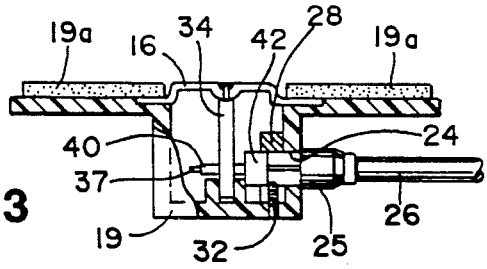
Fig. 3
Fig. 5
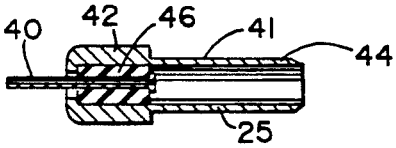
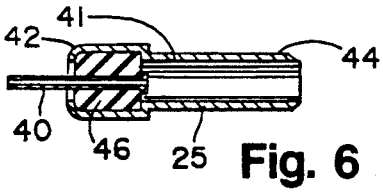
Fig. 6
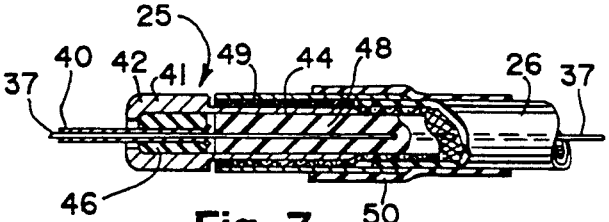
Fig. 7

ANTENNA WITH PUSH-IN CABLE CONNECTOR

FIELD OF THE INVENTION

The present invention concerns an antenna with a novel antenna cable connector system.

BACKGROUND OF THE INVENTION

There are numerous prior art antennas for mounting on a motor vehicle's window, in which no hole needs to be drilled through the window. An example of such antenna is disclosed in Blaese U.S. Pat. No. 4,862,183. These antennas have found good commercial acceptance for use in cellular telephone systems for automobiles and the like. However, these antennas require the connection of a coaxial cable on the inside of the vehicle to an antenna box that is mounted on the inside of the vehicle's window. Typically the antenna box carries a conventional externally threaded receptacle for a 50 ohm coaxial cable, and typically the distal end of the 50 ohm coaxial cable carries a conventional plug with an internally threaded ring for coupling to the externally threaded receptacle. As illustrated in FIG. 2 of Blaese U.S. Pat. No. 4,862,183, the connection between the coaxial cable and the antenna box requires that a significant amount of coaxial cable extend from the vehicle's frame and upholstery to the antenna box mounted on the window, with a relatively large metal connector extending into the connector box. Since the antenna box is mounted directly to the vehicle's window, many motorists find the coaxial cable extension and connector to be unsightly and undesirable.

I have discovered an antenna and cable connector system which alleviates the unsightliness of the prior art cable and connector system and which enables the distal end of the cable and its connector to be relatively unobtrusive. In this manner, the vehicle may be manufactured at the factory with a built-in cable so that if an antenna box is attached to the window at a later date, the distal end of the coaxial cable can be easily and attractively connected to the antenna box.

Therefore, it is an object of the present invention to provide an antenna cable connector system that is attractive in appearance.

Another object of the present invention is to provide an antenna cable connector system that is relatively easy to assemble and efficient to manufacture.

A still further object of the present invention is to provide an on-glass antenna that utilizes an antenna cable connector system that is relatively unobtrusive.

Other objects and advantages of the present invention will become apparent as the description proceeds.

SUMMARY OF THE INVENTION

In accordance with the present invention, an antenna cable connector system is provided. The system of the present invention comprises a coaxial cable having a main central conductor, a coaxial dielectric, a coaxial braid conductor and an outer insulative jacket. A connector is provided having a conductive tube at its distal end receiving the main central conductor. The connector has a main body portion insulatively spaced from said conductive tube and a greater inner diameter than the conductive tube. The connector receives the coaxial dielectric and carries the coaxial braid conductor thereon.

In the illustrative embodiment, an antenna box is provided having means for receiving the connector with a push-in fit. The receiving means includes a conductive member having an opening for receiving the conductive tube.

In the illustrative embodiment, the main body portion comprises a continuous front portion and rear portion. The front portion has an insulative spacer therein and has a conductive outer surface that is exposed to the outside. The rear portion receives the coaxial dielectric and has an outer surface that carries the braid conductor thereon, with a sleeve overlying the rear portion.

In the illustrative embodiment, the main body portion has a maximum outer diameter of about 0.250 inch.

In the illustrative embodiment, the receiving means comprises a slotted conductive member with the slot tightly receiving the conductive tube. The antenna box has means for fastening the connector to the antenna box with the fastening means comprising a set screw located within a laterally extending passageway defined by the box for locking engagement with the connector.

In the illustrative embodiment, the antenna box has an electrically conductive inner transfer member for connection to the window of a vehicle, and means are providing for connecting the receiving means conductor member to the inner transfer member. The fastening means includes a conductive member for conductively connecting the main body portion to ground or to a ground plane.

A more detailed explanation of the invention is provided in the following description and claims, and as illustrated in the accompanying drawings.

BRIEF DESCRIPTION OF THE DRAWINGS

FIG. 1 is a perspective view, partially in cross-section for clarity, of an antenna system constructed in accordance with the principles of the present invention;

FIG. 2 is a diagrammatic top view of the antenna box of FIG. 1;

FIG. 3 is a cross-sectional view, taken along the plane of the line 3—3 of FIG. 2;

FIG. 4 is a perspective view of the distal end of a coaxial cable with the slotted receiving member;

FIG. 5 is a cross-sectional view of a portion of a connector according to one embodiment of the present invention;

FIG. 6 is a cross-sectional view of a portion of a connector according to another embodiment of the present invention;

FIG. 7 is a cross-sectional view of a cable and connector system constructed in accordance with the principles of the present invention; and FIG. 8 is an exploded view thereof.

DETAILED DESCRIPTION OF THE ILLUSTRATIVE EMBODIMENTS

Referring to FIG. 1, glass plate window 10 of a vehicle is illustrated, preferably the rear window, with a current-fed radiator 12 being positioned on the exterior surface 10*a* of window 10. Radiator 12 is mounted on an outer housing which comprises a plastic, weather resistant carrier 15 having an electrically conductive outer transfer plate 13 in electrical connection with radiator 12. Housing 15 is affixed to the outer surface 10*a* of the glass window by suitable adhesive 15*b*, such as a pressure-sensitive adhesive, with outer transfer plate 13 being held by the adhesive against surface 10*a*.

The remaining portions of the antenna assembly are located on the inside of the vehicle; i.e., on the opposing surface 10*b* of window 10. Such elements include electrically conductive inner transfer plate 16, which is held against surface 10*b* of glass plate 10 by means of adhesive 19*a*.

Inner transfer plate 16 is located within an antenna box 19 which is a plastic member adhered to the interior of window 10*b* by a peripheral zone of contact adhesive 19*a*, in a manner similar to outer housing 15. Antenna box 19 carries a pair of field-cancelling radials, 20, 22 (FIG. 2) which extend in opposite directions from each other, are connected to the ground conductor of a coaxial cable 26 as described below, and are operative to cancel the electromagnetic field in the plane of the field-cancelling radials. It is to be understood, however, that although a current-fed antenna system is illustrated as the preferred embodiment, the antenna cable and connector system of the present invention may be used with a voltage-fed antenna system also.

Referring to FIGS. 2 and 3, the plastic antenna box defines an opening 24 for receiving the connector 25 of coaxial cable 26. Adjacent to opening 24 is a metallic ground member 28, to which the field-cancelling radials 20 and 22 are electrically connected. Member 28 defines an opening 30 for receiving a set screw 32. Set screw 32 is used to lock the connector 25 of the coaxial cable 26 to the antenna box 19.

The antenna box 19 also carries a electrically conductive receiving member 34 that defines a slot 36 for tightly receiving the main conductor 37 of the coaxial cable 26. Member 34 is electrically connected to the electrically conductive inner transfer member 16 so as to conduct current from the main conductor of the coaxial cable to the inner transfer member 16.

The connector 25 for the coaxial cable 26 allows cable 26 to be pushed into the antenna box 19 through opening 24, and then fastened by laterally extending set crew 32 in sharp contrast to prior art connectors which are threadedly connected to the receptacle by means of an internally threaded ring that fastens to the externally threaded receptacle.

Referring to FIGS. 5–8, the connector 25 comprises an electrically conductive tube 40 at its distal end for receiving the main conductor 37 of the coaxial cable. The connector 25 has an electrically conductive main body portion 41 comprising a front portion 42 and a rear portion 44. Front portion 42 carries an insulative spacer 46 for insulating conductive tube 40 from main body portion 41. Rear portion 44 receives and surrounds the dielectric 48 (FIG. 7) of the coaxial cable and is continuous with front portion 42. Rear portion 44 also carries the braid conductor 49 of the cable on its outer surface.

Connecting the coaxial cable to the connector is relatively simple, in that the main conductor 37 and the surrounding dielectric 48 are pushed into rear portion 44. The main conductor will extend through the bore of conductive tube 40 and the tube is fixed to the main conductor 37 by solder or by crimping the tube 40. The dielectric will extend into rear portion 44, and the braid 49 can be manually located about the outer surface of rear portion 44 so as to spread it evenly about the outer surface of rear portion 44. Then, a metallic crimp sleeve 50, which is placed around the cable prior to attachment of the main body portion 41, is slid toward the end of the coaxial cable so as to enclose the braid. Once the crimp sleeve is as close to front portion 42 as possible, the crimp sleeve is crimped to maintain the assembly. The connector has now been attached to the distal end of the cable.

Opening 24 of the antenna box 19 has an internal diameter that is substantially equal to the external diameter of the coaxial connector 25 so that the connector can now be pushed into opening 24, with the tube 40 extending into slot 36 of recessed member 34. Laterally extruding set screw 32 is then tightened to fix the assembly in place.

It can be seen that there is no need to connect an exposed threaded ring as in the prior art and that a very clean connection can be provided, without the need to have an extensive amount of coaxial cable extending from the frame of the vehicle to the antenna box.

In the embodiment of FIG. 6, a constant impedance type of connector is shown. In both the FIG. 5 and FIG. 6 embodiments, the outer diameter of the connector is preferably no greater than about 0.250 inch which provides an effective size for a conventional 50 ohm coaxial cable. It is preferred that the front portion 42 have an 0.250 inch external outer diameter, while the rear portion 44 preferably haws an outer diameter of about 0.175 inch, to allow the braid to overlie it and then allow the crimp sleeve to overlie the braid.

Although illustrative embodiments of the invention have been shown and described, it is to be understood that various modifications and substitutions may be made by those skilled in the art without departing from the novel spirit and scope of the present invention.

I claim:

1. An antenna system for mounting on a motor vehicle's glass plate with a radiator extending from a carrier attached to a first side of the glass plate and with an electrical connector and a coaxial cable extending from a second, opposite side of the glass plate whereby energy is transferred through the glass plate and the drilling of a hole for connecting the radiator to the electrical connector is unnecessary, comprising:

an outer RF transfer member comprising a weather resistant carrier having a first electrically conductive member on its underside for engagement with the outside of the window;

a radiator located on the outside of the window and connected to said first electrically conductive member;

an inner RF transfer member including an antenna box and having a second electrically conductive member on its underside for engagement with the inside of the window;

a coaxial cable having a main central conductor, a coaxial dielectric, a coaxial braid conductor, and an outer insulative jacket;

a connector having a main body portion receiving said coaxial dielectric and a sleeve located proximal to said main body portion for surrounding said outer insulative jacket;

an antenna box having means for receiving said connector with a push-in fit, said receiving means including a conductive member having an opening for receiving said main central conductor with said push-in fit; and said antenna box carrying means for transferring energy from the coaxial cable to said radiator.

2. An antenna cable connector system as defined by claim 1, said main body portion comprising a continuous front portion and rear portion, said front portion having an insulative spacer therein and having a conductive outer surface that is exposed to the outside.

3. An antenna cable connector system as defined by claim 2, said rear portion receiving said coaxial dielectric and having an outer surface that carries said braid conductor thereon, and a sleeve overlying said rear portion.

4. An antenna cable connector system as defined by claim 1, said main body portion having an outer diameter no greater than about 0.250 inch.

5. An antenna cable connector system as defined by claim 1, said receiving means comprising a slotted conductive member with the slot tightly receiving said conductive tube.

6. An antenna cable connector system as defined by claim 1, said antenna box having means for fastening said connector to said antenna box.

7. An antenna cable connector system as defined by claim 6, said fastening means comprising a set screw located within a passageway defined by said box for locking engagement with said connector.

8. An antenna cable connector system as defined by claim 6, said transferring means comprising a pair of field-cancelling radials extending from said antenna box, said fastening means including a conductive member for conductively connecting said main body portion to said field-cancelling radials.

9. An antenna as defined by claim 1, in which said connector has a conductive tube at its distal end receiving said main central conductor.

10. An antenna for mounting on a motor vehicle's window, which comprises:

an outer RF transfer member comprising a weather resistant carrier having a first electrically conductive member on its underside for engagement with the outside of the window;

a radiator adapted to be located on the outside of the window and connected to said first electrically conductive member;

an inner RF transfer member including an antenna box and having a second electrically conductive member on its underside for engagement with the inside of the window;

a coaxial cable having a main central conductor, a coaxial dielectric, a coaxial braid conductor, and an outer insulative jacket;

a connector having a main body portion receiving said coaxial dielectric and a sleeve located proximal to said main body portion for surrounding said outer insulative jacket;

an antenna box having means for receiving said connector with a push-in fit, said receiving means including a conductive member having an opening for receiving said main central conductor with said push-in fit;

said antenna box carrying means for transferring energy from said coaxial cable to said radiator; and means for fastening said cable to said antenna box, said fastening means comprising a set screw located within a laterally extending passageway defined by said box for locking engagement with said connector.

* * * * *